US005339775A

United States Patent [19]

Clarke et al.

[11] Patent Number: 5,339,775

[45] Date of Patent: Aug. 23, 1994

[54] COOLING ARRANGEMENT FOR A PISTON ASSEMBLY

[75] Inventors: John M. Clarke, Chillicothe, Ill.; Padmanabhan R. Ranganathan, Fort Worth, Tex.

[73] Assignee: Caterpillar Inc., Peoria, Ill.

[21] Appl. No.: 176,928

[22] Filed: Jan. 3, 1994

[51] Int. Cl.[5] ..... F07P 1/04

[52] U.S. Cl. ..... 123/41.35; 92/66; 91/196

[58] Field of Search ..... 123/41.34, 41.35, 42; 91/196, 206; 92/66, 117 A, 117 R

[56] References Cited

U.S. PATENT DOCUMENTS

| | | | |
|---|---|---|---|
| 1,678,957 | 7/1928 | Philipp | 123/41.35 |
| 1,820,628 | 8/1931 | Niven | 123/41.35 |
| 1,878,566 | 9/1932 | Woolson | 123/41.35 |
| 1,905,582 | 4/1933 | Gazda | 123/41.35 |
| 1,953,109 | 4/1934 | Heron | 123/41.35 |
| 2,153,501 | 4/1939 | Harper, Jr. | 123/41.35 |
| 3,485,143 | 12/1969 | Canady | 92/176 |
| 3,630,178 | 12/1971 | Erickson | 123/50 |

*Primary Examiner*—Noah P. Kamen
*Attorney, Agent, or Firm*—William C. Perry

[57] ABSTRACT

Conventional cooling arrangements for the piston assemblies mounted within an engine block include the use of coolant that is circulated through the engine block. Generally, a plurality of cavities or water jackets are positioned in areas of high heat production within the engine block and the coolant is circulated between them and a radiator dissipate the heat created through engine operation. This method of cooling however requires the engine block to be stationary with respect to the pistons that reciprocated within to facilitate the circulation of the coolant within the block. The present invention provides a cooling arrangement for a first piston member that reciprocates within an engine block and in turn mounts at least one second piston member therewithin. The first piston member includes a sealed cavity that is positioned about a bore in which the second piston member is mounted for reciprocation. The cavity contains a cooling agent that dissipates the heat created within the first piston member as it reciprocates within the engine block.

7 Claims, 3 Drawing Sheets

COOLING ARRANGEMENT FOR A PISTON ASSEMBLY

TECHNICAL FIELD

This invention relates to a cooling arrangement for a piston assembly and more particularly to a cooling arrangement for a piston that reciprocates within an engine and further defines at least one cylinder in which a second piston assembly is operatively mounted.

BACKGROUND ART

In conventional engine designs, it is quite common to employ a cooling system wherein a cooling medium, such as water or other suitable cooling agent, is circulated throughout the various components of an engine to dissipate the heat that is generated by the operation of an engine. More particularly, the engine block defines strategically positioned cavities or water jackets through which a flow of coolant is allowed to circulate. The coolant is normally circulated between the engine block and a radiator by an engine driven pump to dissipate heat that is created within the engine block. One main source of heat stems from the movement of the pistons within the cylinders and the combustion that creates such movement.

While this method of cooling has been known to be very effective for cooling the areas around the cylinders of a conventional engine block, it must be noted that this particular method of cooling relates only to the stationary portions of an engine block. It does not address a means by which the reciprocating members of an engine may be specifically cooled.

There are however, known methods used to cool the pistons of an engine. One such method is disclosed in U.S. Pat. No. 3,485,143, issued to Arthur R. Canady on Dec. 23, 1969. The Canady patent discloses the use of a sealed cavity in the upper region of the piston where the heat is known to be excessive. The cavity is filled with a cooling agent that acts as a heat exchanger to cool the crown portion of the piston as it reciprocates within its cylinder. This cooling arrangement however, applies only to a design that utilizes a piston assembly that is housed for reciprocation within a stationary cylinder.

In other engine designs having more advanced technology, piston arrangements are disclosed that utilize multiple piston arrangements that reciprocate with respect to one another. One such concept is disclosed in U.S. Pat. No. 3,630,178, issued to Frederick I. Erickson on Dec. 28, 1971. This patent discloses a primary or working piston that is moveable within a secondary combustion chamber member. The secondary combustion chamber member is in turn mounted for reciprocation within a cylinder formed by a stationary housing. It is apparent from a review of the disclosure that the combustion and expansion of gases within the interacting piston and moveable chamber would naturally create a substantial amount of heat in both moving members. While there are passages provided in the block of the engine through which water may be circulated to provide cooling of the block, there is no provision for cooling either of the moveable pistons.

The present invention is directed to overcoming one or more of the problems as set forth above.

DISCLOSURE OF THE INVENTION

In one aspect of the present invention, there is provided a cooling arrangement for a piston assembly that is mounted for reciprocating movement within an operating chamber of an engine block. The arrangement includes a first piston member that has first bore defined therethrough. A second piston member is disposed for reciprocating movement within the first bore. A cavity is defined in the first piston member and is positioned to substantially surround the first bore. The cavity is sufficient for receiving and maintaining a preselected amount of a cooling agent.

In another aspect of the present invention, a cooling arrangement is provided for a piston assembly that is mounted for reciprocating movement within an operating chamber of an engine block. The cooling arrangement includes a first piston member that has a first bore defined therethrough. A pair of second piston members are disposed for reciprocating movement within the first bore. A cavity is defined in the first piston member and is positioned to substantially surround the first bore. The cavity is sufficient for receiving and maintaining a preselected amount of a cooling agent.

With the cooling arrangement as described above, the heat that is generated in a first piston assembly by the combustive forces of a second piston assembly housed within the first piston assembly is transferred to the external surroundings of the first piston assembly. This is accomplished by the positioning of a sealed cavity around the bore or cylinder in which the second piston assembly operates. The cavity is filled with a cooling agent that acts as a heat exchanger to direct the heat that is generated internally of the first piston assembly to the outer surfaces thereof. Since the cavity itself is moving up and down with the first piston assembly, the cooling capabilities of the cooling agent is enhanced through its agitation. In addition to being positioned parallel to the bore in which the second piston member is reciprocating, a portion of the cavity extends in a direction that is normal to the direction of piston movement. Being so directed, the cooling agent is allowed to reach an area that is in close proximity to the combustion chamber of the second piston member which is an area of intense heat generation.

BEST MODE FOR CARRYING OUT THE INVENTION

Figure 1:
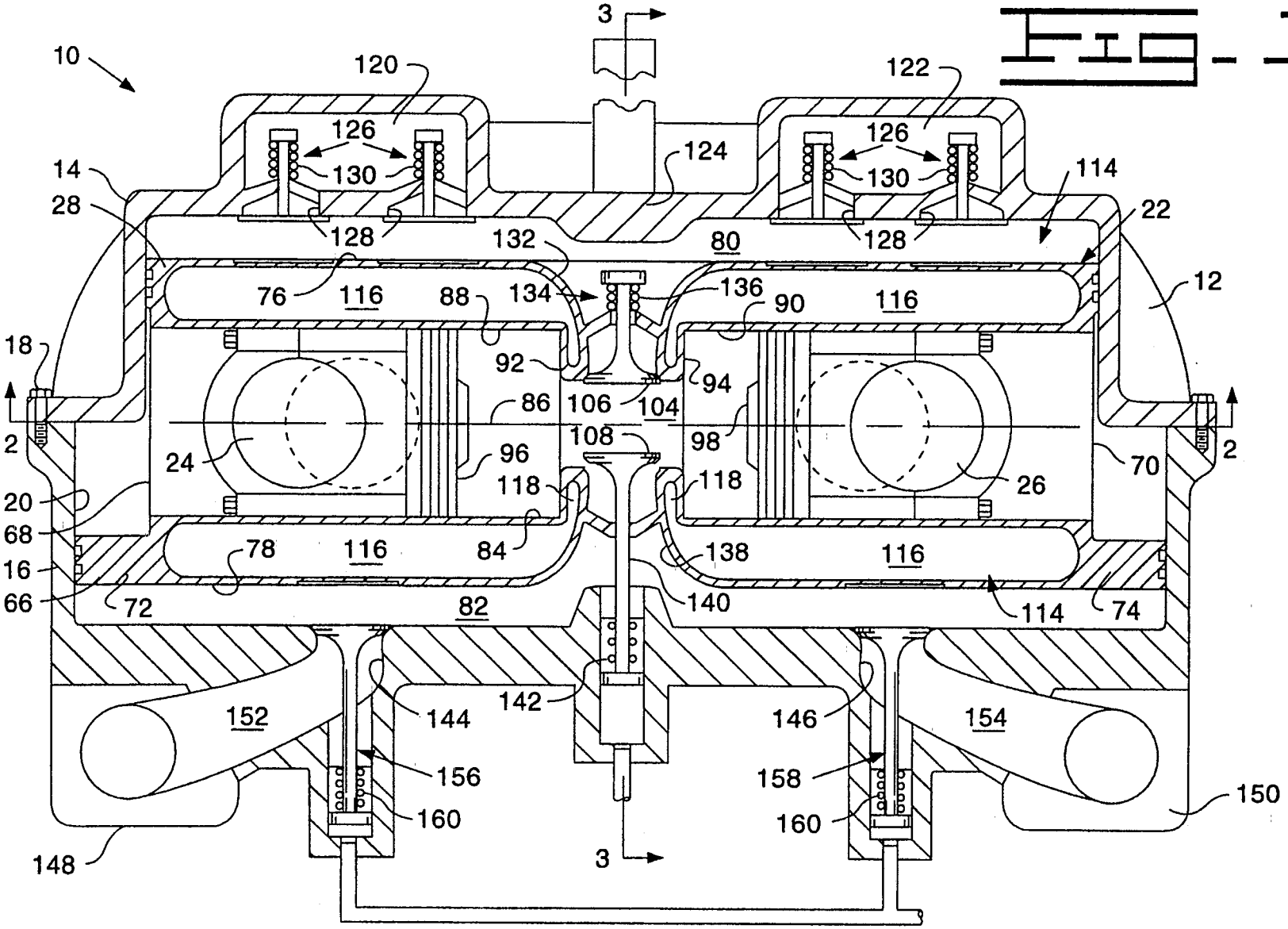
FIG. 1 is a diagrammatic transverse cross-sectional view of an internal combustion engine constructed in accordance with the present invention.

Referring now to the drawings, it can be seen that an internal combustion engine 10 is shown that is defined by a housing 12. The housing 12 includes a first or upper portion 14 and a second or lower portion 16. The two housing portions are secured together by a plurality of fasteners or bolts 18. The housing 12 defines an operating chamber 20 in which a multi-piston subassembly 22 is positioned for reciprocating movement in a generally vertical plane as viewed in FIG. 1.

The multi-piston subassembly 22 includes a first and second crankshaft 24 and 26, a first, relatively large low pressure piston member 28, and a pair of second, high pressure piston members 30 and 32.

The first crankshaft 24, includes a plurality of longitudinally aligned spaced main bearing journals 34 having a central axis 36 and a cylindrical crankpin 38. The crankpin 38 is radially offset from the axis 36 of the main bearing journals. Each of the main bearing journals 34 of the first crankshaft 24 is rotatably supported between the upper and lower housing portions 14 and 16 in a conventional manner. A first rear timing and balancing gear 40 is connected to a rear power take-off end 42 of the first crankshaft 24 externally of the housing 12. A second front timing and balancing gear 44 is connected to an opposite front end 46 of the first crankshaft 24 externally of the housing 12.

Figure 2:
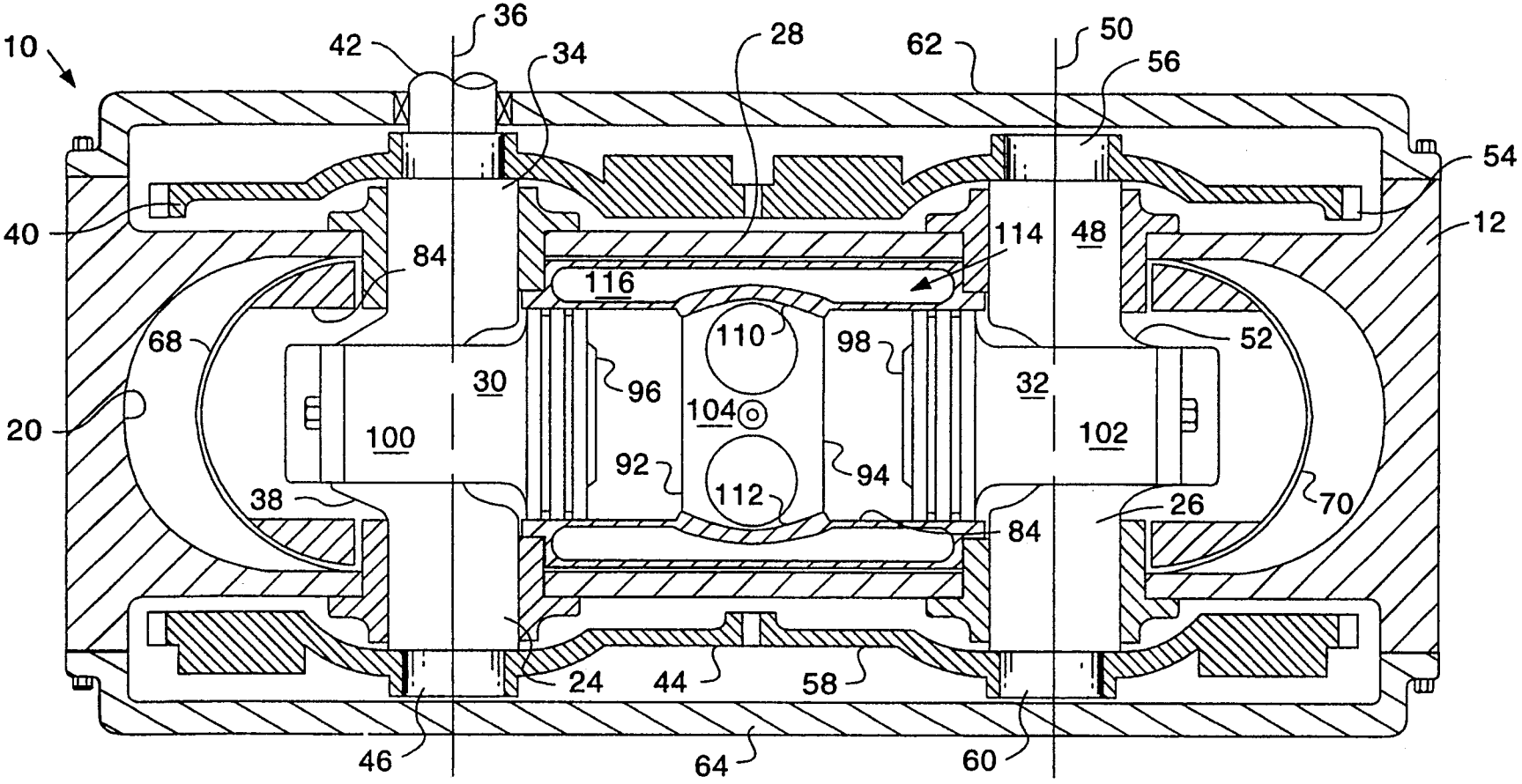
FIG. 2 is a diagrammatic cross-sectional view of the engine shown in FIG. 1 taken along line 2—2 thereof.

As is illustrated in FIG. 2, the second crankshaft 26 includes a plurality of spaced, longitudinally aligned main bearing journals 48 having a central axis 50, and a cylindrical crankpin 52. The crankpin 52 is axially offset with respect to the main bearing journals 48 in a conventional manner. Each of the bearing journals 48 of the second crankshaft 26 is rotatably supported between the first and second housing portions 14 and 16 of the housing 12, in a conventional manner. The axes 36 and 50 of the first and second crankshafts 24 and 26 are generally parallel.

A third rear timing and balancing gear 54 is connected to a rear end 56 of the second crankshaft 26 externally of the housing 12 and in mesh with the first rear timing gear 40. A fourth front timing and balancing gear 58 is connected to an opposite front end 60 of the second crankshaft 26 externally of the housing 12 and in mesh with the second front timing gear 44. The rear first and third gears 40 and 54 mesh with one another and the front second and fourth gears 44 and 58 mesh with one another to impart phased counter rotation of the first and second crankshafts 24 and 26. A rear cover 62 is removably secured to the rear of the housing 12 to enclose the first and third gears 40 and 54 and a front cover 64 is removably secured to the front of the housing to enclose the second and fourth gears 44 and 58.

The first piston member 28 is of generally oblong shape and is reciprocally and sealably disposed in the operating chamber 20 of the housing. The first piston member 28 includes a body 66 having a left and right end portion 68 and 70 respectively. Each of the end portions is semicylindrical in configuration and defines an outwardly extending flange 72 and 74 respectively.

The body 66 of the first piston member 28 further includes a top working surface 76 and a bottom working surface 78. The disposition of the top working surface 76 within the first housing portion 14 defines an intake chamber 80 of variable volume. The disposition of the bottom working surface 78 within the second housing portion 16 defines an exhaust chamber 82 also of variable volume. The first piston member 28 is reciprocally moveable in the operating chamber 20 in a downward first direction, increasing the volume of the intake chamber 80 and reducing the volume of the exhaust chamber 82. Conversely, when the first piston member moves in an upward second direction, the volume in the intake chamber is decreased while the volume of the exhaust chamber is increased.

The first piston member 28 also defines a first bore 84 along a central axis 86 that is parallel to and is positioned substantially equidistantly between the top and bottom working surfaces 76 and 78. The first bore further defines a first and second piston bore 88 and 90 respectively. The first piston bore 88 is defined between the left end portion 68 of the first piston member 28 as viewed in FIG. 1 and a first radially disposed endwall 92 positioned in the first bore 88. The second, piston bore 90 is defined between the right end portion 70 of the first piston member and a second radially directed endwall 94 disposed in the first bore 84 in spaced relationship with the first endwall 92. One of the second piston members 30 is positioned within the first piston bore 88 while the other of the second piston members 30 is positioned within the second piston bore 88. Both of the second piston members 30 and 32 are conventional in configuration defining a cylindrical head portion 96 and 98 respectively, that are positioned within the respective piston bores 88 and 90. The pistons are positioned in opposed relationship to one another with the head portions 96 and 98 facing the respective endwalls 68 and 70. Each of the respective second piston members has an end cap 100 and 102 that extends from the respective head portions 96 and 98 in opposite directions. The end cap 100 is pivotally connected directly to the crankpin 38 of the first crankshaft 24 in a conventional manner, while the connecting rod 102 is pivotally connected directly to the crankpin 52 of the second crankshaft 26 in a similar manner.

A combustion chamber 104 is defined in the body 66 of the first piston member 28 between the opposed head portions 96 and 98 of the respective second piston members 30 and 32. The combustion chamber 104 is of variable volume and is defined by a horizontal top surface 106, a horizontal bottom surface 108, a pair of concave side surfaces 110 and 112 of the piston body 66 (FIG. 2), and the opposed head portions 96 and 98 of the high pressure pistons 30 and 32.

Figure 3:
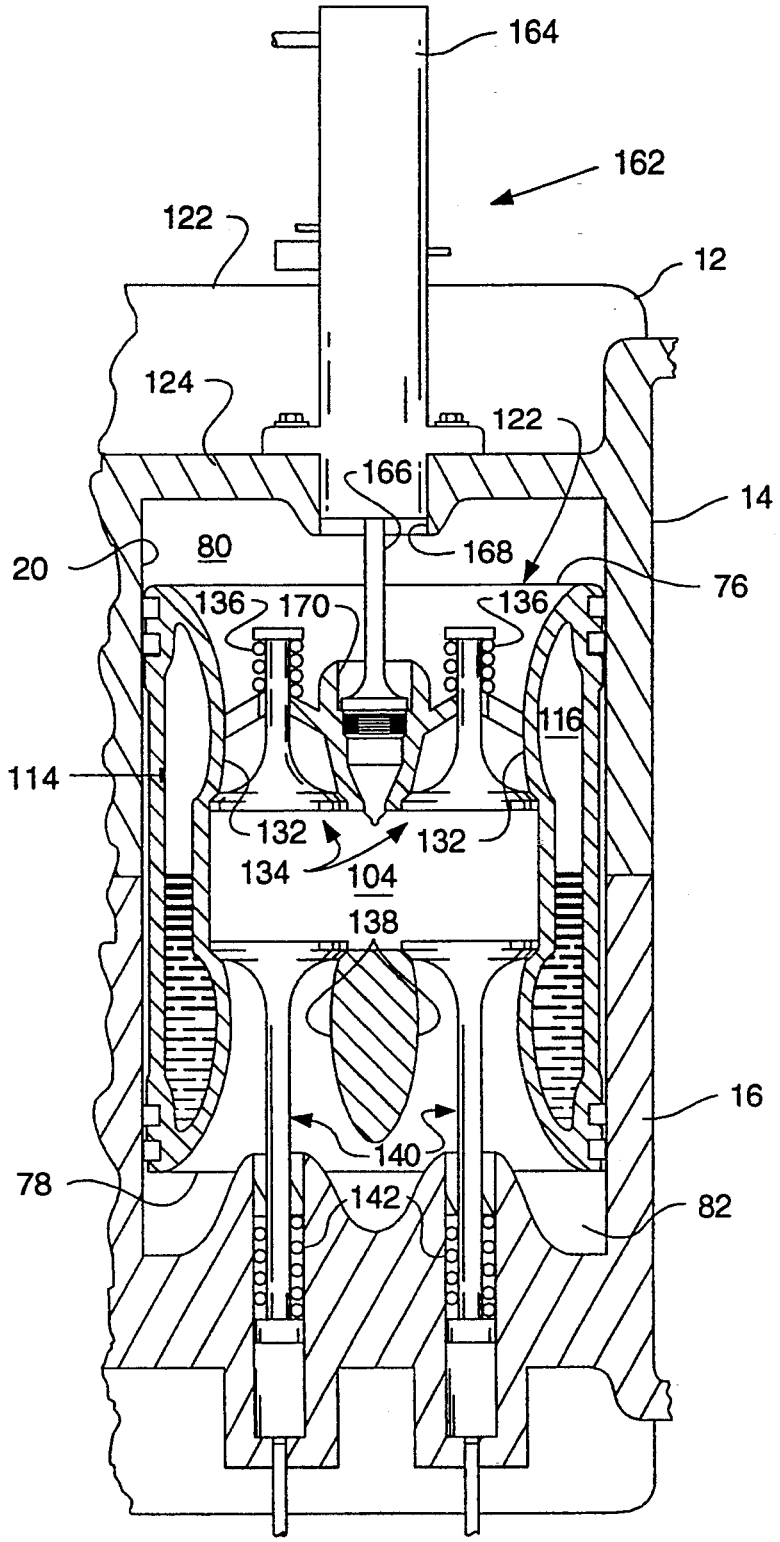
FIG. 3 is a diagrammatic transverse cross-sectional view of the engine shown in FIG. 1 taken along line 3—3 thereof.

A coolant cavity 114 is defined in the piston body 66 that is positioned in surrounding relationship to the first bore 84. The cavity defines a first portion 116 that extends parallel to the top and bottom working surfaces 76 and 78 of the piston body. As can best be seen in FIG. 1, a second cavity portion 118 extends inwardly from the first cavity portion 118 toward the combustion chamber 104 to a location that is closely adjacent and substantially parallel to each of the radially disposed endwalls 92 and 94. Referring to FIGS. 2 and 3, it can be seen that the first cavity portion is narrowed substantially due to the configuration of the piston body and is disposed about the concave side surfaces 110 and 112 defined by the combustion chamber 104. The coolant cavity 114 is sufficient for receiving and maintaining a preselected amount of cooling agent such as water or any other suitable liquid since it is a sealed chamber.

As shown in FIG. 1, the first portion 14 of the housing 12 further includes a pair of induction air manifolds 120 and 122 that serve as induction passages. A wall member 124 separates the induction passages from the intake chamber 80 defined in the first portion 14 of the operating chamber 20. A plurality of self opening induction popper valve assemblies 126 are positioned in a plurality of induction ports 128 defined in the wall member 124. Each poppet valve assembly is conventional in construction utilizing a valve spring 130 to maintain the valve in a closed condition until it is selectively opened to communicate induction air between the induction passages and the intake chamber.

The first piston body 66 defines a pair of intake ports 132 that are transversely aligned across the piston as can best be seen in FIG. 3. The intake ports 132 extend between the top working surface 76 of the first piston member 28 and the top surface 106 of the combustion chamber 104. Each intake port 132 receives an intake poppet valve assembly 134 of the self opening variety. Each intake valve assembly 134 is conventional in design and utilizes a valve spring 136 to maintain the valves 134 in their closed position until such time when it is desirable to communicate the intake chamber 80 with the combustion chamber 104.

The first piston body 66 further defines a pair of profiled exhaust ports 138. Like the intake ports 132, the exhaust ports are transversely aligned across the first piston member. The exhaust ports 138 communicate between the combustion chamber 104 and the exhaust chamber 82 defined beneath the bottom working surface 78 of the first piston member 28 as viewed in FIG. 1. A pair of exhaust valve assemblies 140 are operatively mounted in each of the exhaust ports 138 to provide selective communication between the combustion chamber 104 and the exhaust chamber 82. The exhaust valve assemblies 140 are conventional in design and utilize a valve spring 142 to maintain the valve in a closed position to normally prevent such communication. An exhaust valve actuating means (not shown) is utilized to provide the necessary timed actuation of the exhaust valves in response to the movement and operation of the other engine components.

As best shown in FIG. 1, the second portion 16 of the housing 12 defines a pair of scavenge ports 144 and 146. The scavenge ports connect the exhaust chamber 82 with a pair of scavenge manifolds 148 and 150 via passages 152 and 154 respectively. A pair of scavenge valve assemblies 156 and 158 are positioned in the respective scavenge ports 144 and 146 and are selectively operable to communicate the exhaust chamber 82 with the exhaust manifolds 148 and 150. The scavenge valve assemblies 156 and 158 are provided with a valve spring 160 to maintain the valves in a closed position. A scavenge actuating means (not shown) is utilized to selectively actuate the valves to provide the appropriate timed operation of the valves.

As is best shown in FIG. 3, a fuel injector means 162 is disclosed that includes a pump body 164 that is secured to the wall member 124 of the housing 12. A fuel injector 166 extends through a pair of aligned bores 168 and 170 in the wall member 124 and the first piston member 28 respectively, to communicate with the combustion chamber 104. Fuel is delivered to the fuel pump body 164 under pressure from a remote reservoir (not shown) and is subsequently delivered in sequentially timed response to the reciprocation of the first piston member 28 to the combustion chamber 104. The fuel is in turn, ignited in a well known manner to provide rotation of the crankshafts 24 and 26 thus power to the rear power takeoff shaft 42.

Industrial Applicability

In operation, the pair of opposed, second piston members 30 and 32 are directly mounted on the respective pair of crankpins 38 and 52 of the counter-rotating crankshafts 24 and 26. The second piston members 30 and 32 are reciprocally and sealably disposed in their respective piston bores 88 and 92 of the first piston member 28 and are driven by combustion of the fuel in the combustion chamber 104 to cause rotation of the crankshafts. The orbital movement of the second piston assemblies and the pressure caused by the expanding exhaust gas in the exhaust chamber 82 combine to act on the bottom working surface 78 of the first piston member 28 to reciprocally drive the first piston member in the operating chamber 20. It is to be understood that other multi-piston subassemblies can be added along the crankshafts 24 and 26 by adding additional crankpins and other additional control means in the manner of the additional cylinders of an in-line conventional engine.

For the purpose of description, the operation of the engine 10 begins with the downward movement of the first piston member 28 from a position wherein the top working surface 76 is adjacent the wall member 124. As the first piston member moves in a downward direction, the intake chamber 80 enlarges and the pressure within the intake chamber falls below that of the induction manifolds 120 and 122. The higher pressure in the induction passages overcomes the induction valve springs 130 causing the induction valves 126 to open. At the same time, air is being compressed in the combustion chamber 104 by the movement of the second piston members 30 and 32 towards each other. As a result, the high pressure within the combustion chamber 104 holds the intake valves 134 in their closed position. As the second pistons reach their closest point, fuel is injected into the combustion chamber from the fuel injection means 162 creating ignition and expansion of the gases within the combustion chamber. As the first piston member 28 continues to move downward, scavenge valve assemblies 156 and 158 are opened to allow the gases in the exhaust chamber 82 to be forced through the scavenge ports 144 and 146 to the respective manifolds 148 and 150. Upon reaching the maximum extent of its downward stroke, the exhaust valves 140 positioned in the first piston member 28 are opened to allow the exhaust gases in combustion chamber 104 to flow into the exhaust chamber 82 under pressure. This pressure in the exhaust chamber in turn, urges the first piston member in an upward direction. As the first piston member moves up in the operating chamber 20, it compresses the air in the intake chamber 80. As its upward movement continues, the pressure within the intake chamber increases under compression. At a certain point, the pressure exerted by the valve springs 136 to hold intake valves in their closed position, will be overcome by the pressure of the air in the intake chamber 80. The intake valves 134 will then be forced to open thus allowing the pre-compressed air in the intake chamber 80 to flow into the combustion chamber 104. The air in the combustion chamber is subsequently compressed as the rotation of the crankshafts 24 and 26 brings the second piston members 30 and 32 back together. Fuel is sequentially injected into the combustion chamber once again to create combustion and expansion of the air/fuel mixture and the aforementioned cycle is repeated.

It can be seen from the foregoing description of operation that the first piston member 28 is subjected to a great deal of heat, not only from the combustion and expansion of gases within the combustion chamber 104, but from the internal friction created by the reciprocating movement of the second piston members 30 and 32 with the first bore 84. It is also apparent that since the first piston member 28 itself reciprocates within the operating chamber 20 of the housing 12 that conventional methods of cooling the first piston member are not applicable. By providing the sealed cavity 114 around the bore 84 and in particular around the first and second piston bores 88 and 90, a cooling agent such as water, is constantly positioned about the heat producing areas of the first piston member 28 to dissipate the heat within it and, thus, isothermalize it. Further, the reciprocating movement of the first piston member agitates the coolant within the cavity which in turn results in a high heat transfer coefficient within the cavity. This permits a greater heat transfer rate to the surroundings of the first piston member. Also, the second portion 118 of the cavity 114 extends radially along the endwalls 92 and 94 of the piston bores 88 and 90 to the region closely adjacent the combustion chamber 104. Since this region is relatively remote in comparison to conventional engines, cooling of this region ensures safe metal temperatures during engine operation. Yet another advantage that is realized by the provision of the cavity 114 in the first piston member 28 is the reduction of mass in the first piston member which is the dominant reciprocating member in the engine. This reduction in mass will improve the transient response of the engine as well as reduce the maximum speed fluctuations of the crankshafts and their maximum angular deflection that would otherwise present a problem.

Other aspects, objects and advantages of this invention can be obtained from a study of the drawings, the disclosure and the appended claims.

We claim:

1. A cooling arrangement for a piston assembly mounted for reciprocating movement within an operating chamber of an engine block, comprising:

a first piston member having a first bore defined therethrough;

at least one second piston member disposed within the first bore for reciprocating movement therein; and a cavity defined in the first piston member and being positioned to substantially surround the first bore, said cavity containing a fluid.

2. The cooling arrangement as set forth in claim 1 wherein a pair of second piston members are disposed within the first bore for reciprocating movement therein.

3. The cooling arrangement as set forth in claim 2 wherein a pair of first and second radially disposed endwalls are positioned within said first bore in axially spaced relationship to one another to form a combustion chamber between the second piston members.

4. The cooling arrangement as set forth in claim 3 wherein the cavity further defines a first portion that extends parallel to the first bore to surround each of the second piston members and a pair of second portions that extend from the first portion to a position that is adjacent and substantially parallel to each of the radially disposed endwalls.

5. The cooling arrangement as set forth in claim 4 wherein an intake valve assembly is mounted in the first piston member for selective communication with the combustion chamber, said intake valve assembly being positioned between the respective second cavity portions in closely adjacent relationship thereto.

6. The cooling arrangement as set forth in claim 5 wherein an exhaust valve assembly is mounted in the first piston member for selective communication with the combustion chamber, said exhaust valve assembly being positioned between the respective second cavity portions in closely adjacent relationship thereto and being positioned on an opposite side of the first bore from the intake valve assembly.

7. The cooling arrangement as set forth in claim 5 wherein the water is water.

* * * * *